US010765894B2

(12) United States Patent
Balke et al.

(10) Patent No.: US 10,765,894 B2
(45) Date of Patent: Sep. 8, 2020

(54) HEAD PROTECTION DEVICE AND RESPIRATOR DEVICE

(71) Applicant: DRÄGER SAFETY AG & CO. KGAA, Lübeck (DE)

(72) Inventors: Olaf Balke, Reinfeld (DE); Martin Rademacher, Grossheirath (DE); Katja Franke, Lübeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 1299 days.

(21) Appl. No.: 14/974,215

(22) Filed: Dec. 18, 2015

(65) Prior Publication Data

US 2016/0175624 A1 Jun. 23, 2016

(30) Foreign Application Priority Data

Dec. 19, 2014 (DE) ..... 10 2014 019 204

(51) Int. Cl.

| | |
|---|---|
| ***A62B 18/04*** | (2006.01) |
| ***A42B 3/22*** | (2006.01) |
| ***A42B 3/28*** | (2006.01) |
| ***A62B 18/00*** | (2006.01) |
| ***A62B 18/08*** | (2006.01) |
| ***A62B 18/10*** | (2006.01) |

(52) U.S. Cl.

CPC ..... *A62B 18/04* (2013.01); *A42B 3/225* (2013.01); *A42B 3/286* (2013.01); *A62B 18/003* (2013.01); *A62B 18/10* (2013.01); *A62B 18/082* (2013.01)

(58) Field of Classification Search

CPC ..... A62B 18/003; A62B 18/04; A62B 18/045; A62B 18/082; A42B 3/222–223; A42B 3/225; A42B 3/286; A42B 3/288

See application file for complete search history.

(56) References Cited

U.S. PATENT DOCUMENTS

| | | | | |
|---|---|---|---|---|
| 2002/0104533 | A1* | 8/2002 | Kalhok | A42B 3/226 128/201.24 |
| 2010/0294270 | A1* | 11/2010 | Curran | A62B 18/003 128/201.23 |
| 2011/0048416 | A1* | 3/2011 | Brace | A42B 3/288 128/201.24 |

(Continued)

FOREIGN PATENT DOCUMENTS

| | | |
|---|---|---|
| DE | 1200689 B | 9/1965 |
| DE | 41 91 244 T1 | 2/1994 |

(Continued)

OTHER PUBLICATIONS

Machine translation of Schimpf DE 102004048843 (Year: 2006).*

*Primary Examiner* — Valerie L Woodward

(74) *Attorney, Agent, or Firm* — McGlew and Tuttle, P.C.

(57) ABSTRACT

A head protection device (2), for protecting the head, includes a head bracket (4), with a visor (8) fastened rotatably to the head bracket (4) via two swivel joints (6), and with a branched air duct (10), which has one air inlet (12) and a plurality of air outlets (14). At least one of the air outlets (14) is arranged as a chin air outlet (20) at a lateral section (22) of the visor. At least one of the swivel joints (6) forms an inner air channel (24) extending as a part of the air duct (10) from the head bracket (4) to the visor (8). In addition, a respirator device is provided with the head protection device (2).

17 Claims, 3 Drawing Sheets

(56) References Cited

U.S. PATENT DOCUMENTS

2013/0139816 A1* 6/2013 Proctor ..... A62B 18/02
128/204.15

FOREIGN PATENT DOCUMENTS

| | | | |
|---|---|---|---|
| DE | 102004048843 | A1 | 4/2006 |
| DE | 102012019835 | A1 | 4/2014 |
| FR | 2596281 | A1 | 10/1987 |
| WO | 98/06458 | A1 | 2/1998 |
| WO | 2008/118768 | A1 | 10/2008 |

* cited by examiner

HEAD PROTECTION DEVICE AND RESPIRATOR DEVICE

CROSS REFERENCE TO RELATED APPLICATIONS

This application claims the benefit of priority under 35 U.S.C. § 119 of German Patent Application 10 2014 019 204.0 filed Dec. 19, 2014, the entire contents of which are incorporated herein by reference.

FIELD OF THE INVENTION

The present invention pertains to a head protection device for protecting the head, with a head bracket, with a visor fastened to the head bracket by means of two swivel joints, and with a branched air duct, which has one air inlet and a plurality of air outlets, wherein at least one of the air outlets is arranged as a forehead air outlet at an upper section of the visor, and wherein at least one of the air outlets is arranged as a chin air outlet at a lateral section of the visor.

The present invention pertains, in addition, to a respirator device with an air supply unit for providing an air flow, with a head protection device, which has a branched air duct with at least one air inlet and a plurality of air outlets, and with an air supply line, which extends from the air supply unit to the air inlet of the head protection device in order to guide the air flow provided by the air supply unit to the air inlet.

BACKGROUND OF THE INVENTION

Such head protection devices and respirator device are known from the state of the art. If a person is using a head protection device, at least the person's facial area is protected by the head protection device or the visor belonging to it. Visors are likewise known, in principle, from the state of the art. A visor may have, for example, a frame as well as a transparent pane, which extends between portions of the frame and is preferably arched. The disk is preferably designed as a plastic disk.

The visor is fastened rotatably to a head bracket of the head protection device. A swivel joint each, which is used for said fastening to the head bracket, may be arranged for this at opposite end sections of the visor. The visor can be folded relative to the head bracket with the swivel joints for rotating or pivoting, for example, from a closed state, in which said facial area is protected, into an open state, in which the visor is folded away from the face. Provisions are made in this connection for the head protection device to be able to be fastened on the head of the person using the head protection device by means of the head bracket. Various embodiments of head brackets are known from the state of the art. For example, the head bracket may thus be formed by a plastic strap, especially an adjustable plastic strap. As an alternative or in addition, the heat bracket may be associated with a helmet shell. The helmet shell may be, for example, a half shell, a full shell or a helmet of another design. The helmet would also be a part of the head bracket in this case. Provisions are consequently made for the head protection device to pertain to both masks with a head bracket and with a visor as well as to helmets with a visor. The term masks shall be defined broadly in the sense of the present invention.

A protective mask with a head bracket and with a visor is known, for example, from DE 41 91 244 T1. The visor has a frame, which supports an extent of an eye-protecting lens. Lateral openings, which are designed as elongated holes and via which fresh air introduced into the frame through a connecting branch flows, directed against the eye-protecting lens, are provided in the frame.

If fresh air is caused to flow into a space between the visor and the face exclusively through lateral openings in the frame of the visor, it was observed in practice that this may lead to a feeling of high velocities of flow, especially in the areas of the nose, in a person using such a head protection device. A branched air duct for head protection devices is known for reducing the velocity of flow at the outlet openings. The branched air duct has one air inlet and a plurality of air outlets. The air may be admitted, for example, in the area of the head protection device corresponding to the back of the head. The air is ducted in this case from the area corresponding to the back of the head to the area corresponding to the forehead. It is there that the air outlets are arranged. At least one of the air outlets is arranged as a forehead air outlet at an upper section of the visor. The forehead air outlet is not necessarily arranged for this at the visor itself. The forehead air outlet may rather be designed such that it is at the person's forehead or at the upper area of the forehead. The air flowing out of the forehead air outlet can thus flow against the upper area of the inner side of the visor and/or in parallel thereto into the space between the visor and the face. An air outlet may be formed, in principle, by at least one opening but preferably a plurality of openings. The direction of flow from the openings of an air outlet may be directed obliquely in relation to one another in a limited range of angles. This range of angles may be, for example, 25°. In addition, at least one of the air outlets is arranged as a chin air outlet at a lateral section of the visor. The at least one chin air outlet is likewise not necessarily fastened to the visor. However, it may preferably be fastened to the visor. Furthermore, it is preferred that at least two chin air outlets are provided, which are arranged, located opposite each other, at the chin area of a person, who may optionally use the head protection device. Air flows through each of the chin air outlets in the direction of the inner side of the visor, which inner side is located opposite the chin of the aforementioned person. If, for example, one forehead air outlet and two chin air outlets, which are located opposite each other, are provided for the head protection device, fresh air flows into an area between the visor and the face of the person using the head protection device from three different directions. Such an air inflow is perceived by said person with markedly reduced disturbances in the facial area.

Such an embodiment of a head protection device can be seen, for example, in WO 2008/118768 A1. The branched air duct is a rigid air duct. This means that the air always flows at the same position through the corresponding air ducts into the space between the visor and the face of the person who is using the head protection device.

To make possible the best possible mechanical protection of the face, the visor is preferably to be arranged close to the face of the person who may be using the head protection device. Therefore, there is a conflict with the branched air duct or the air outlets, which are preferably likewise in the vicinity of the face. Prior-art head protection devices therefore often require a large space for construction in order to ensure that both the visor can be arranged close to the face and the air is discharged from the air outlets as close to the face as possible.

SUMMARY OF THE INVENTION

A basic object of the present invention is therefore to provide the most compact head protection device possible of the above-mentioned type. In particular, the air duct belonging to the head protection device and the visor shall be arranged in a space-saving manner in relation to one another.

This object is accomplished by the head protection device according to the present invention for protecting the head, with a head bracket, with a visor fastened rotatably on the head bracket by means of two swivel joints, and with a branched air duct, which has one air inlet and a plurality of air outlets, wherein at least one of the air outlets is arranged as a forehead air outlet at an upper section of the visor, and wherein at least one of the air outlets is arranged as a chin air outlet at a lateral section of the visor, wherein at least one of the swivel joints forms an air channel extending from the head bracket to the visor as a part of the air duct.

A basic idea of the present invention is to provide the swivel joints with a dual function. Consequently, the swivel joints fasten the visor rotatably at the head bracket. In addition, the swivel joints each form a part of the air duct. One of the air outlets of the air duct, namely, the forehead outlet, is not usually in conflict with the visor in respect to the space needed for construction. By contrast, it may lead to a collision in the state of the art with the at least one joint of the head protection device and/or with the visor in the part of the air duct that extends to the at least one chin air outlet, especially when the visor is designed as a visor foldable to the head bracket by means of the joints. Due to the at least one swivel joint forming an air channel extending from the head bracket to the visor as a part of the air duct, the air duct as a whole can be integrated in the head protection bracket in a more compact manner. The air duct can thus extend at first close to the head bracket from an area corresponding to the back of the head to an area corresponding to the forehead area, where the air duct will then branch out in order to lead to the forehead air outlet with one branch and to the air channel formed by the at least one joint with another branch. The air duct can then lead farther with the corresponding branch to the chin area. The visor can be folded with such a design relative to the head bracket without there being any collision in the area closely surrounding the joints between the visor and the air duct, because the air duct is formed in said area at least partially by the joints, or by at least one of the joints, themselves. This collision-free design makes it possible to create an especially compact air duct as well as head bracket for the head protection device, the visor being fastened to the head bracket, mounted by swivel joints.

In addition, provisions are preferably made for the air outlets to be arranged on the inner side towards the visor. The air outlets are therefore preferably designed and/or oriented such that an air flow from the air outlets flows towards the visor and/or the corresponding visor pane. The discharge directions of these air outlets can consequently be directed towards the visor. The air flowing from the air outlets therefore supplies the person, who is using the head protection device, with fresh breathing air, since the air flowing from the air outlets flows into the so-called facial space, which is located between the visor and the face of said person. The facial space is consequently defined by the visor and the face of said person. To achieve the most complete definition possible of the facial space, which reduces the ambient effect on the facial space, it proved to be advantageous if a sealing ring is provided, which is fastened with a first ring end to the visor, especially to the corresponding frame, and which has a second ring end, which can be fastened around the head of said person. The sealing ring is preferably a fabric sealing ring, so that the second ring end can be fastened with an elastic strap or with a cord to the head of said person. In addition, an ambient outlet, designed preferably as a nonreturn outlet valve, through which air can flow out into the surrounding area from the facial space, may be provided at the visor and/or at the sealing ring. This ensures that an exchange of air takes place in the facial space with the air flow flowing into the facial space through the air outlets, because an at least similar quantity of air flows out into the surrounding area through the ambient air outlet.

One advantageous embodiment of the head protection device is characterized in that each swivel joint has a hollow cylindrical joint housing and a hollow shaft held by the joint housing in a rotating manner, wherein the corresponding air channel passes through the hollow shaft. The hollow shaft of the particular joint is consequently used in this case to form the respective corresponding air channel. The visor can therefore be rotated or folded in relation to the head bracket without interrupting the air duct, especially to the at least one chin outlet. The branched air duct is therefore protected from external contaminating effects, for example, dust or sand, even when the visor is rotated and/or the visor is folded up. Therefore, only the air introduced through the air inlet will flow from the air outlets of the air duct.

Another advantageous embodiment of the head protection device is characterized in that the air channel formed by the respective swivel joint is made coaxial and/or parallel to a corresponding axis of rotation. The coaxial orientation of the air channel with the axis of rotation of the swivel joint, which forms the respective air channel, proved to be especially advantageous in practice, since the air channel preferably remains unchanged during the rotation of the visor relative to the head bracket. Consequently, the passage cross section of the air channel is not restricted in this case. This may be advantageous for certain applications of the head protection device. As an alternative, it also proved to be advantageous if the air channel is arranged in parallel to the axis of rotation of the swivel joint, which forms the respective air channel, because such swivel joints can transmit especially strong forces through a shaft in the central, coaxial area, which guarantees secure holding of the visor at the head bracket. In addition, provisions may be made for the passage cross section of the air channel, especially the middle passage cross section thereof, to be able to be modified and/or adjusted with a rotation of the joint. The air resistance through the air channel can thus be made adjustable by rotating the joint. Such an adjustability likewise proved to be advantageous in practice when different distributions of the air flowing out through the air outlets are desirable as a function of the position of the visor.

Another advantageous embodiment of the head protection device is characterized in that each air channel is configured to guide air to a chin outlet. The air channels are defined in this case as the air channels formed by the swivel joints. Air flowing into the air duct through the air inlet is sent proportionately to the head bracket-side inlet of the air channel formed by the respective swivel joint, so that a corresponding percentage of the air flows through the air channel. Provisions are preferably made based on this for an air duct element to adjoin the joint on the outside, with the air duct element forming another air channel, which leads the air channel formed by the respective joint farther to the chin air outlet. It proved to be advantageous for an especially compact design of the head protection device if the air duct element is formed by a frame, especially by a frame section, of the visor. The frame or frame section of the visor has a dual function in this case, which keeps the space necessary for construction for the head protection device especially small.

Another advantageous embodiment of the head protection device is characterized in that each swivel joint is additionally designed as a rotary throttle valve for the corresponding air channel or for another air channel leading to the forehead outlet. The cross section of the air channel of the corresponding swivel joint and/or the cross section of the additional air channel to the forehead outlet can consequently be reduced and/or expanded with the swivel joint. The air flow through the respective air channel can thus be affected by means of the swivel joint. The corresponding air flow can therefore be throttled by rotating the swivel joint or by rotating the corresponding hollow shaft relative to the joint housing. Throttling may take place to the extent that no air flow will flow through the respective air channel. The air channel can consequently preferably be blocked. Conversely, the throttling may also be abolished to the extent that the respective air channel is fully released. The air can consequently flow, unhindered by the effect of the rotary throttle valve, through the respective air channel. It proved to be advantageous in practice if a valve means, which is configured to open, throttle and/or close the respective air channel, is associated with the swivel joint. The functionality of a throttle valve is known, in principle, from the state of the art. The control of the respective valve means is combined here with the joint, so that a rotary throttle valve is therefore meant.

Another advantageous embodiment of the head protection device is characterized in that the visor is configured as a lever for adjusting the rotary throttle valves. The visor is fastened rotatably to the head bracket by means of the two swivel joints. The visor is thus fastened, for example, to the respective hollow shafts of the swivel joints. The hollow shafts will therefore also rotate relative to the joint housings with the folding up of the visor, so that adjustment of the valve means is possible. A reverse embodiment is likewise conceivable, in which the visor is connected, for example, to the joint housings. The user of the head protection device can therefore determine the throttling of the air flow through the respective air channel, which can be affected by means of the rotary throttle valve, with the folding up and especially with the respective opening angle of the visor.

Another advantageous embodiment of the head protection device is characterized in that each rotary throttle valve is configured to modify an air resistance through the corresponding air channel and/or to open or close the corresponding air channel. A throttle valve structure, which is configured to reduce, release and/or close the respective air channel, may be provided for this. The rotary throttle valve or the corresponding valve structure is consequently used to modify the air resistance through the corresponding air channel.

Another advantageous embodiment of the head protection device is characterized in that each rotary throttle valve is configured to modify an air resistance through a bypass air channel of the air duct to the forehead outlet. An air channel of the air duct leads to the forehead outlet. This air channel may also be called a primary air channel for the forehead outlet. The bypass air channel extends in parallel to the at least one section of the primary air channel in order to direct air to the forehead outlet. The overall air resistance for the air flowing to the forehead outlet is therefore composed of the air resistance of the primary air channel and the air resistance of the bypass air channel. Due to the air resistance through the bypass air channel being able to be modified by means of a rotary throttle valve, the overall air resistance for the air flowing to the forehead outlet can be made variable as well. The rotary throttle valve may be designed, insofar as this is meaningful, analogously to the explanations given above for the rotary throttle valves. The bypass air channel can consequently be blocked, throttled and/or fully released with the rotary throttle valve for modifying the air resistance through the at least one bypass air channel. The distribution of the air flowing to the air outlets can also be controlled due to the variability of the air resistance through the at least one bypass air channel. If the air resistance through the at least one bypass air channel is increased, a smaller quantity of air will flow to the at least one corresponding forehead outlet. A large quantity of air will flow, instead, to the chin outlets. Analogous statements can be made for the reverse case. If the at least one bypass air channel is fully released, a larger quantity will again flow through the at least one forehead outlet and correspondingly a smaller quantity of air to the chin outlets. Different settings are possible in between for the rotary throttle valve and the corresponding air resistance through the at least one bypass air channel, which will result in corresponding distributions for the air flowing to the air outlets.

Another advantageous embodiment of the head protection device is characterized in that each rotary throttle valve is formed by at least one jacket-side passage opening of the joint housing of the corresponding swivel joint and at least one jacket-side passage opening of the hollow shaft of the corresponding swivel joint. The joint housing and the hollow shaft preferably have each at least two jacket-side passage openings. The air resistance through the corresponding rotary throttle valve can be set by a relative rotation of the hollow shaft in relation to the joint housing of the rotary throttle valve, because the hollow shaft with its jacket-side passage opening can be caused to overlap the jacket-side passage opening of the corresponding joint housing, so that said two openings will form a common passage. The air channel formed by the swivel joint preferably passes through this passage or the passage openings. The passage cross section can be increased or reduced by rotating the hollow shaft. The maximum passage cross section is determined by the maximum overlap of the two openings. If the two openings have no overlap, a corresponding passage with a corresponding air resistance is blocked. Such a design of a swivel joint proved to be advantageous for the head protection device, because an adjustment of the rotary throttle valves, which are formed by the swivel joints, and with which the visor can be rotatably fastened to the head bracket, is associated at the same time with an adjustment of the visor. The user of the head protection device can consequently adjust the distribution of the air to the different air outlets by pivoting the visor. The rotary throttle valves may be designed here such that the distribution of the air to the air outlets will change when the visor is pivoted from a closed position into an opened position.

Another advantageous embodiment of the head protection device is characterized in that the jacket-side passage opening of the corresponding joint housing and the jacket-side passage opening of the corresponding hollow shaft are arranged in relation to one another in the circumferential direction of the axis of rotation of the swivel joint for each swivel joint such that each rotary throttle valve formed by the respective swivel joint is opened when the visor is in an opened position, and each rotary throttle valve formed by the respective swivel joint is closed or in a throttled position when the visor is in a closed position. This embodiment proved to be especially advantageous when the air resistance through a bypass channel of the air duct to the forehead outlet can be modified with the rotary throttle valves. Consequently, two bypass channels leading to the forehead outlet can be provided, and a rotary throttle valve each, formed by the swivel joints, is provided for each of the two bypass channels in order to modify the air resistance through the respective bypass channel. If the visor is in a closed position, the air resistance through the bypass channels is increased, for example, to the extent that the respective bypass channel is blocked. The air resistance effective for the air flowing to the forehead outlet is thus increased, so that an especially large percentage of the air flowing in through the air inlet is directed to the chin outlets. An advantageous air distribution will therefore become established in case of a closed visor in the space between the visor and the face of the person using the head protection device according to the present invention. If the visor is folded up now, so that it is in an opened position, it is advantageous if the percentage of the air being discharged from the chin outlets is reduced and the percentage of the air being discharged through the forehead outlet is increased, because the head protection device is frequently used in dusty environments, where there is a risk that dust and/or loose dirt will settle on a front section of a helmet and/or on the forehead of the person using the head protection device. If the chin outlets are integrated and/or fastened, for example, at a lateral section of the frame of the visor, there is a risk when the visor is folded up that the air flow being discharged from the chin outlets will dislodge the aforementioned dust and/or the aforementioned loose dirt, and these will fall down on or in front of the face of the person using the head protection device. There is a risk in this case that the dust or dirt will get into the eyes of the person (wearer) and/or that the person will unintentionally inhale same. To prevent this as much as possible from happening, the air flow from the chin outlets, which are also folded up by the visor frame, should be reduced and/or stopped altogether. Since the rotary throttle valves or the corresponding valve means can be adjusted with the pivoting of the visor, the air flow through the chin outlets can be reduced in the opened position of the visor. The rotary throttle valves can reduce the air resistance through the bypass channels, and they can preferably release the bypass channels completely, so that at least a large portion of the air flowing in through the air inlet will flow out through the forehead outlet. The forehead outlet is preferably not fastened to the frame of the visor. The location of the forehead outlet is consequently independent from the frame of the visor and/or the visor pane, so that the visor can be folded relative to the forehead outlet. If the visor is brought now into the opened position, the forehead outlet remains regardless in its previous location. Therefore, the air being discharged from the forehead outlet does not dislodge the dust and/or rock particles possibly located on a front side of a helmet and/or on the front side of the head of the person using the head protection device. In other words, the aforementioned dust and/or the aforementioned rock particles cannot get into the eyes and/or into the nose of the person using the head protection device.

Another advantageous embodiment of the head protection device is characterized in that the air duct is configured such that when the rotary throttle valves are closed or in the throttling position, between 60% and 80% of the air fed through the air inlet is guided to the chin outlets. In addition, provisions may be made for 60% to 90% of the air flowing through the air inlet to be guided to the forehead outlet when the rotary throttle valves are opened or in a released position. A large percentage of the air flowing through the chin outlets with the visor closed will therefore flow through the forehead outlet when the visor is opened. This reduces the velocity of flow of the air being discharged at the chin outlets when the visor is opened, so that the risk of removal of dust or rock particles from the front side of a helmet or from the front side of the head of the person using the head protection device is thus already markedly reduced. The statements made above therefore apply analogously.

According to another aspect, the object mentioned in the introduction is accomplished by a respirator device with an air supply unit for providing an air flow, with a head protection device according to the present invention, which has a branched air duct with at least one air inlet and a plurality of air outlets, and with an air supply unit, which extends from the air supply unit to the air inlet of the head protection device, in order to guide the air flow provided by the air supply unit to the air inlet. Features, details and advantages that are described in connection with the head protection device according to the present invention also apply, of course, in connection with the respirator device according to the present invention and vice versa, so that reference is or can always mutually be made to the individual aspects of the present invention concerning the disclosure. The air supply unit may be a stationary air supply unit or a mobile air supply unit. In particular, the air supply unit may be designed as an air blower type supply unit (such as with a filter). An energy storage means, for example, a battery, and a control, especially for controlling the blower, may also be associated with this blower type air supply unit for the mobile air supply unit. The air duct is preferably an air hose. The air flow is sent through this from the air supply unit to the air inlet of the head protection device.

The present invention will be described below without limitation of the general idea of the invention on the basis of exemplary embodiments with reference to the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
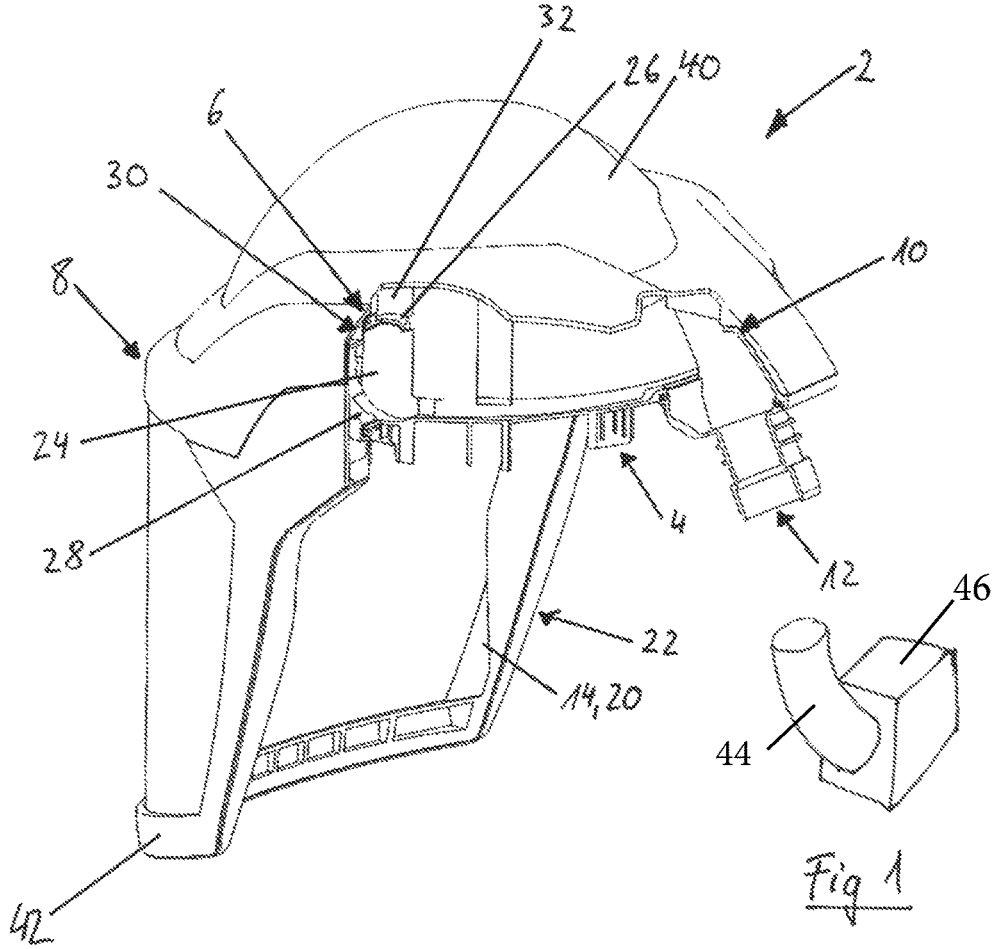
FIG. 1 is a schematic perspective view of the head protection device with a partial section through the air duct ans showing an air supply line and an air supply unit.

Referring to the drawings, FIG. 1 shows the head protection device 2 according to the present invention. The head protection device 2 is used to protect the head of a person who is using the head protection device 2. The head protection device 2 has, for this, a head bracket 4. As can be seen in FIG. 1, the head bracket 4 is formed by a helmet 40. The helmet 40 has, at its inner wall, a head strap, with which the helmet 40 can be firmly fastened on the upper body of the person. The term head bracket 4 is consequently defined broadly.

Figure 4:
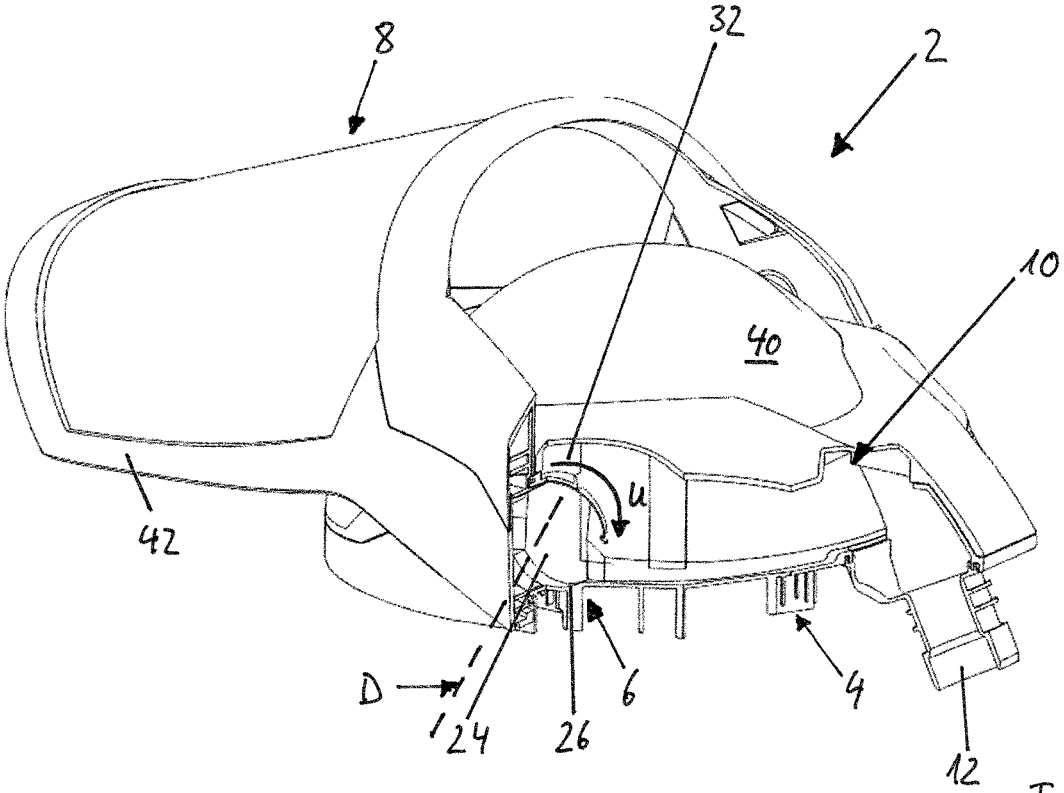
FIG. 4 is another schematic perspective view of the head protection device with the visor opened and with a sectional view through the air duct corresponding to the section in FIG. 1.

To protect the face of the person using the head protection device 2, a visor 8 is provided for the head protection device 2. The visor 8 is fastened rotatably at the head bracket 4 or at the helmet 40. Two swivel joints 6, which establish the mechanical connection between the visor 8 and the head bracket 4 or the helmet 40, are provided for this. The visor 8 can be pivoted by means of the swivel joints 6 between a closed position, as it can be seen in FIG. 1, and an opened position, as it can be seen in FIG. 4. In other words, the visor 8 is mounted pivotably at the head bracket 4 or at the helmet 40.

Figure 3:
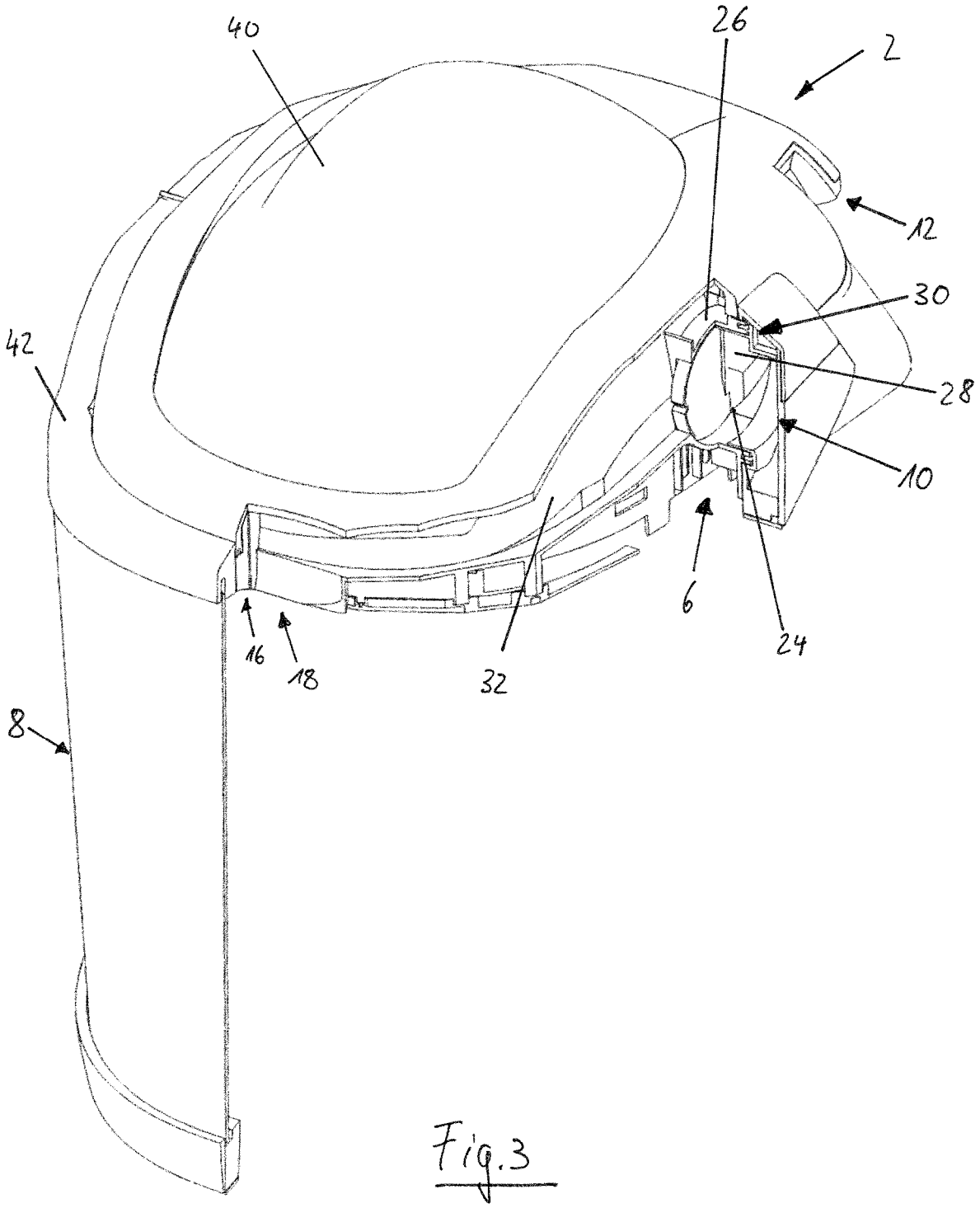
FIG. 3 is another schematic perspective view of the head protection device with another section through the air duct.

Such a head protection device 2 is frequently used in dusty or dirty environments. To make fresh breathing air available to the user of the head protection device during use, the head protection device 2 has a branched air duct 10. The air duct 10 comprises for this an air inlet 12 and a plurality of air outlets 14. The air inlet 12 is connected to an air supply line 44 that is connected to an air supply unit 46. The air inlet 12 is preferably arranged at the rear part of the head bracket 4 or of the helmet 40, i.e., preferably on the side of the head bracket 4 or of the helmet 40 facing away from the visor. From there, the air duct 10 leads to the area of the head protection device 2 that corresponds to the forehead area thereof. At least one of the air outlets 14 is formed in this case as a forehead air outlet 16, as this can be seen in FIG. 3. The forehead air outlet 16 is arranged at an upper section of the visor of the head protection device 2. As can be seen in FIG. 3, the forehead air outlet 16 is formed by the helmet 40. The forehead air outlet 16 is characterized in that air flows at an upper visor section 18 into a space between the visor 8 and an area that is intended for the head of the user of the head protection device 2. Provisions may be made, as an alternative, for the forehead air outlet 16 to be formed by an upper frame section of the visor 8. However, this is not shown in the figures.

Moreover, at least one of the air outlets 14 is arranged as a chin air outlet 20 at a lateral visor section 22. The chin air outlet 20 may be designed, in principle, independently from the position of the visor 8. As can be seen in FIGS. 1 through 5, the at least one chin air outlet 20 is formed, however, by a lateral frame of the visor 8. The chin outlet 20 is characterized in that air flows into a space between a lateral area 22 of the visor 8 and an area that is intended for the head of the user of the head protection device 2.

Through the plurality of air outlets 14, 16 of the head protection device 2, air flows on a plurality of sides of the visor 8 into the space between the visor 8 and an area that is intended for the head of the user of the head protection device 2. This guarantees that the velocity of flow of the air flowing in through the aforementioned air outlets 14, 16, 20 can be kept especially low. The person using the head protection device 2 does not therefore feel the air flowing in to be unpleasant due to the low velocity of this air. At the same time, the person is continually supplied with fresh air, i.e., air not polluted with dust or dirt.

It was determined in practice that it is comfortable for the user of such a head protection device 2 if the head protection device 2 is as small as possible and has the lowest weight possible. To achieve this, provisions are made for the head protection device 2 for at least one of the swivel joints 6 to form an inner air channel 24 extending from the head bracket 4 or the helmet 40 to the visor 8 as a part of the air duct 10. Both swivel joints 6 preferably have an identical design, so that they form each a corresponding air channel 24 as a part of the air duct 10. The swivel joints 6 thus assume a dual function, namely, the mounting fastening of the visor 8 at the head bracket 4 or the helmet 40, on the one hand, and the formation of a part of the air duct 10, on the other hand. The head protection device 2 may therefore have an especially compact design, which reduces the weight, on the one hand, and reduces the space needed for installation, on the other hand. The reduced space needed for installation does, in addition, offer a better angle of vision for the person using the head protection device 2.

The swivel joints 6 are formed each by a hollow cylindrical joint housing 26 and a hollow shaft 28 held in a rotatably mounted manner by the joint housing 26, the respective corresponding air channel 24 passing through the hollow shaft 28. Such an embodiment of the swivel joints 6 is seen in FIGS. 1 through 5. The swivel joint housings 26 are associated with the head bracket 4 or the helmet 40. They are consequently stationary in relation to the head bracket 4 or the helmet 40. The hollow shafts 28 of the swivel joints 6 are associated with the visor 8 or a corresponding visor frame 42. The hollow shafts 28 are consequently stationary in relation to the visor 8 or the visor frame 42.

The branched air duct 10 leads from the air inlet 12 with one branch through the air channels 24 of the swivel joints 6. Provisions are made in this connection for the air channels 24 of the swivel joints 6 to pass over at their respective visor-side end into an air channel 24, which is formed by the visor frame 42. The air channels formed by the visor frame 42 then lead to the chin air outlets 20, so that the air can flow out here laterally to the inner side of the visor. Another branch of the branched air duct 10 leads from the air inlet 12 through a corresponding air channel 32, as this can be seen in FIG. 3, to the at least one forehead air outlet 16, at which air can flow out on the inner side of the visor. Due to the swivel joints 6 being used as part of the air duct 10, it is possible that no additional air guide elements of a complicated design are needed to form a connection, which is, for example, a flexibly bendable connection, between the air inlet 12 and the chin air outlets 20.

To make it possible to affect the distribution of the air flowing out through the air outlets 14, it proved to be advantageous to design the swivel joints 6 as rotary throttle valves 30 each. Each swivel joint 6 of the two swivel joints 6 of the head protection device 2 is consequently designed as a rotary throttle valve 30. These rotary throttle valves 30 may be designed, in principle, in such a way as to modify the air resistance through the air channel 24 of the corresponding swivel joint 6. However, an alternative embodiment is shown in FIGS. 1 through 5. Provisions are made here for arranging a bypass channel 34, whose air resistance can be modified by the rotary throttle valves 30, in at least some sections to the air channel 32, which leads from the air inlet 12 to the at least one forehead air outlet 16. Each rotary throttle valve 30 is formed for this by two jacket-side passage openings 36 of the joint housing 26, which said passage openings 36 are located at spaced locations from one another in the circumferential direction U, as well as by at least two jacket-side passage openings 38 of the hollow shaft 28 of the corresponding rotary joint 6, which said passage openings 38 are located at spaced locations from one another in the circumferential direction U. Passage openings 36 of the joint housing 26 and passage openings 38 of the hollow shaft 28 may be opened each in pairs in the same radial direction. Corresponding statements can consequently be made for both pairs of the respective passage openings 36, 38. By rotating the hollow shaft 28 relative to the joint housing 26, the passage openings 38 of the hollow shaft 28 and the passage openings 36 of the joint housing 26 can consequently be caused to overlap, so that the bypass channel 34 is formed in at least some sections through the passage openings 36, 38 and the interior space of the hollow shaft 28. If the bypass channel 34 is released by the rotary throttle valves 30, air will also flow through the bypass channel 34 from the air inlet 12 to the forehead air outlet 16. Based on the released bypass channel 34, the resistance for the air that is flowing from the air inlet 12 to the at least one forehead air outlet 16 is reduced. A larger quantity of air will thus flow through the at least one forehead air outlet 16 and a smaller quantity of air will correspondingly flow through the chin air outlets 20. The distribution of the air flow to the air outlets 14, 16, 20 can consequently be controlled by the rotary throttle valves 30. The person using the head protection device 2 can adjust the rotary throttle valves 30, since the hollow shafts 28 are preferably stationary in relation to the visor 8. The visor 8 may consequently be designed as a lever for adjusting the rotary throttle valves 30. As a function of the opening angle, the valve 30 opens, closes or throttles the bypass channel 34, which is associated with a corresponding distribution of air to the air outlets 14, 16, 20.

Figure 5:
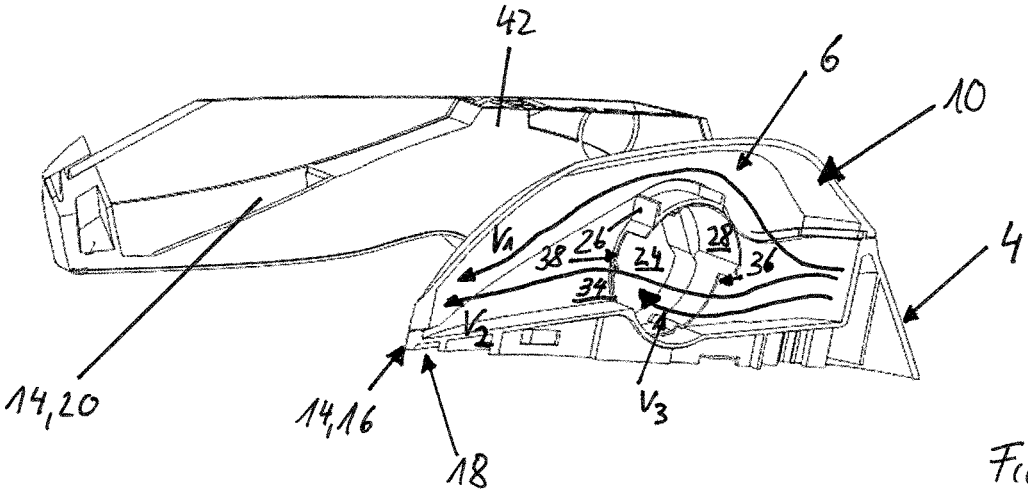
FIG. 5 is a schematic perspective view of a partial assembly unit comprising a part of the frame of the visor as well as a part of a helmet associated with the head protection bracket.

It proved to be advantageous in practice if a reduced quantity of the air flowing in through the air inlet 12 flows out through the chin outlets 20 when the visor 8 is opened since the head protection device is frequently used in dusty areas. If a corresponding dust settles on the top side of the helmet 40, this would be moved down from the top side of the helmet 40 if the discharge of air from the chin air outlets 20 were not reduced with the visor 8 opened, and at least a certain percentage of this dust would then flow past the face of the person using the head protection device 2. To reduce the risk of contamination of the face of the aforementioned person, which is associated herewith, the air flow to the chin outlets 20 is markedly reduced or even completely prevented when the visor 8 is opened. Thus, the above-mentioned risks will not occur. To guarantee a corresponding distribution of air, the swivel joints 6 have a corresponding design. As can be seen in FIG. 5, the bypass channel 34 is opened through the passage openings 36, 38 when the visor 8 is opened, so that two parallel air volume flows V1, V2 will be formed in the area of the bypass channel 34, one of the volume flows, V1, flowing through the original air channel 32 to the forehead air outlet 16 and the second air volume flow, V2, flowing to the forehead air outlet 16 through the bypass channel 34. Another air volume flow, V3, from the air inlet 12 to the chin outlets 20 can be kept especially small, so that the velocity at which the air leaving the chin air outlets 20 is at least essentially not suitable for removing dust on the front top side of the helmet 40.

Figure 2:
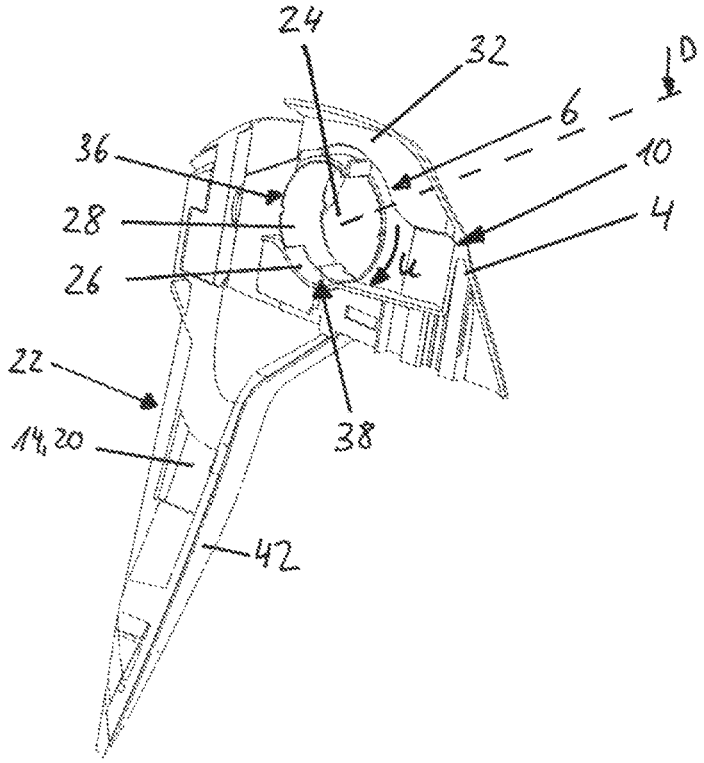
FIG. 2 is a schematic perspective view of a part of the visor frame.

If, as is shown in FIGS. 1, 2 and 3, the visor 8 is folded down again, the bypass channel 34 closes. This leads therefore to a change in the distribution of the air flow to the air outlets 14, 16, 20, and a larger percentage of air will again flow to the chin air outlets 20. The velocity at which the air leaving the forehead air outlet 16 is discharged decreases correspondingly, so that an especially small air flow can be felt in the face by the person using the head protection device 2 when the visor 8 is closed.

While specific embodiments of the invention have been shown and described in detail to illustrate the application of the principles of the invention, it will be understood that the invention may be embodied otherwise without departing from such principles.

LIST OF REFERENCE NUMBERS

D Axis of rotation
U Circumferential direction
2 Head protection device
4 Head bracket
6 Swivel joint
8 Visor
10 Air duct
12 Air inlet
14 Air outlet
16 Forehead air outlet
18 Upper visor section
20 Chin air outlet
22 Lateral visor section
24 Air channel in swivel joint
26 Joint housing
28 Hollow shaft
30 Rotary throttle valve
32 Air channel to forehead air outlet
34 Bypass channel
36 Passage opening of the joint housing
38 Passage opening of the hollow shaft
40 Helmet
42 Visor frame
44 Air supply line

What is claimed is:

1. A head protection device for protecting a head of a wearer, the head protection device comprising:

a head bracket;

a visor fastened rotatably to the head bracket via at least one swivel joint; and a branched air duct comprising one air inlet and a plurality of air outlets, wherein:

at least one of the air outlets is arranged as a forehead air outlet at an upper visor section;

at least one of the air outlets is arranged as a chin air outlet at a lateral section of the visor;

the at least one swivel joint forms an inner air channel extending as a part of the air duct from the head bracket to the visor;

the branched air duct comprises a visor air channel defined by the visor and extending from the inner air channel to the chin air outlet; and the branched air duct comprises a further air channel defined by the head bracket, or the visor or by both the head bracket and the visor and extending from the air inlet to the forehead air outlet;

the at least one swivel joint is configured as a rotary throttle valve;

the rotary throttle valve comprises a first passage opening providing fluid communication between the air inlet and the inner air channel and a second passage opening providing fluid communication between the inner air channel and the forehead air outlet, whereby in an opened state of the rotary throttle valve air passes through the first passage opening, the inner air channel, and the second passage opening to provide air flow from the air inlet to the forehead air outlet in parallel to air flow in the further air channel.

2. A head protection device in accordance with claim 1, wherein the at least one swivel joint comprises a hollow cylindrical joint housing and a hollow shaft held by the joint housing in a rotatably mounted manner, wherein the inner air channel leads through the hollow shaft.

3. A head protection device in accordance with claim 1, wherein the inner air channel formed by the at least one swivel joint is at least one of coaxial and parallel to a corresponding axis of rotation of the at least one swivel joint.

4. A head protection device in accordance with claim 1, wherein the inner air channel is configured to guide air to the chin outlet via the visor air channel.

5. A head protection device in accordance with claim 1, wherein the visor is configured as a lever for adjusting the rotary throttle valve.

6. A head protection device in accordance with claim 1, wherein the rotary throttle valve is configured at least one of to modify an air resistance through the inner air channel and to open or close the inner air channel.

7. A head protection device in accordance with claim 1, wherein:

the at least one swivel joint comprises a hollow cylindrical joint housing and a hollow shaft held by the joint housing in a rotatably mounted manner, wherein the inner air channel leads through the hollow shaft; and the first passage opening of the rotary throttle valve is formed by at least one jacket-side passage opening of the joint housing of the at least one swivel joint and the second passage opening is formed by at least one jacket-side passage opening of the hollow shaft of the at least one swivel joint.

8. A head protection device in accordance with claim 7, wherein:

the jacket-side passage opening of the joint housing and the jacket-side passage opening of the corresponding hollow shaft are arranged in relation to one another in a circumferential direction of an axis of rotation of the swivel joint, whereby:

the rotary throttle valve is in the opened state when the visor is in an opened position; and the rotary throttle valve is closed or in a throttling position when the visor is in a closed position.

9. A head protection device in accordance with claim 8, wherein the air duct is configured such that when the rotary throttle valve is in a closed or throttling position, between 60% and 80% of the air fed through the air inlet is led to the chin air outlet.

10. A respirator device comprising:

an air supply unit for providing an air flow;

a head protection device comprising:

a head bracket;

a visor fastened rotatably to the head bracket via at least one swivel joint; and a branched air duct comprising one air inlet and a plurality of air outlets, wherein:

at least one of the air outlets is arranged as a forehead air outlet at an upper visor section;

at least one of the air outlets is arranged as a chin air outlet at a lateral section of the visor;

the at least one swivel joint forms an inner air channel extending as a part of the air duct from the head bracket to the visor;

the branched air duct comprises a visor air channel defined by the visor and extending from the inner air channel to the chin air outlet;

the branched air duct comprises a further air channel defined by the head bracket, or the visor or by both the head bracket and the visor and extending from the air inlet to the forehead air outlet the at least one swivel joint is further configured as a rotary throttle valve for the inner air channel or for another air channel leading to the forehead outlet; and the rotary throttle valve is configured to modify an air resistance through a bypass air channel of the air duct to the forehead outlet.

11. A respirator device in accordance with claim 10, wherein the at least one swivel joint comprises a hollow cylindrical joint housing and a hollow shaft held by the joint housing in a rotatably mounted manner, wherein the inner air channel leads through the hollow shaft.

12. A respirator device in accordance with claim 10, wherein the inner air channel formed by the at least one swivel joint is at least one of coaxial and parallel to a corresponding axis of rotation of the at least one swivel joint.

13. A respirator device in accordance with claim 10, wherein the inner air channel is configured to guide air to the chin outlet via the visor air channel.

14. A respirator device in accordance with claim 10, wherein:

the visor is configured as a lever for adjusting the rotary throttle valve; and the rotary throttle valve is configured at least one of to modify an air resistance through the inner air channel and to open or close the inner air channel upon adjustment.

15. A respirator device in accordance with claim 10, wherein:

the at least one swivel joint comprises a hollow cylindrical joint housing and a hollow shaft held by the joint housing in a rotatably mounted manner, wherein the air channel leads through the hollow shaft; and the rotary throttle valve is formed by at least one jacket-side passage opening of the joint housing of the at least one swivel joint and at least one jacket-side passage opening of the hollow shaft of the at least one swivel joint.

16. A respirator device in accordance with claim 15, wherein:

the jacket-side passage opening of the joint housing and the jacket-side passage opening of the corresponding hollow shaft are arranged in relation to one another in a circumferential direction of an axis of rotation of the swivel joint, whereby:

the rotary throttle valve is opened when the visor is in an opened position; and the rotary throttle valve is closed or in a throttling position when the visor is in a closed position.

17. A head protection device for protecting a head of a wearer, the head protection device comprising:

a head bracket;

a visor fastened rotatably to the head bracket via at least one swivel joint; and a branched air duct with one air inlet and with a plurality of air outlets, wherein:

at least one of the air outlets is arranged as a forehead air outlet at an upper visor section;

at least one of the air outlets is arranged as a chin air outlet at a lateral section of the visor;

the at least one swivel joint forms an inner air channel extending as a part of the air duct from the head bracket to the visor;

the at least one swivel joint is further configured as a rotary throttle valve for the inner air channel or for another air channel leading to the forehead outlet; and the rotary throttle valve is configured to modify an air resistance through a bypass air channel of the branched air duct to the forehead outlet.

* * * * *